US007296606B2

(12) United States Patent
Liang

(10) Patent No.: US 7,296,606 B2
(45) Date of Patent: Nov. 20, 2007

(54) VENETIAN BLIND SLAT CONTROL MECHANISM

(76) Inventor: Wen Ying Liang, No. 276, Minzu Rd., Lugang Town, Changhua County (TW)

( * ) Notice: Subject to any disclaimer, the term of this patent is extended or adjusted under 35 U.S.C. 154(b) by 317 days.

(21) Appl. No.: 11/092,924

(22) Filed: Mar. 30, 2005

(65) Prior Publication Data

US 2006/0169420 A1 Aug. 3, 2006

(30) Foreign Application Priority Data

Jan. 31, 2005 (TW) ..... 94201744 U

(51) Int. Cl.
*E06B 9/303* (2006.01)

(52) U.S. Cl. ..... 160/115; 160/168.1 R

(58) Field of Classification Search ..... 160/115, 160/114, 166.1 R, 168.1 R, 173 R, 176.1 R, 160/177 R, 178.1 R, 178.2
See application file for complete search history.

(56) References Cited

U.S. PATENT DOCUMENTS

| | | | | |
|---|---|---|---|---|
| 2,117,953 | A * | 5/1938 | Grau | 160/114 |
| 3,100,013 | A * | 8/1963 | Randmark | 160/168.1 R |
| 4,377,194 | A * | 3/1983 | Tsuhako | 160/168.1 R |
| 6,648,048 | B2 * | 11/2003 | Lai | 160/115 |
| 7,100,664 | B2 * | 9/2006 | Hsu | 160/115 |
| 7,159,636 | B2 * | 1/2007 | Liang | 160/115 |

* cited by examiner

*Primary Examiner*—David Purol
(74) *Attorney, Agent, or Firm*—Chan Law Group LLP

(57) ABSTRACT

A Venetian blind slat control mechanism comprises a set of first string ladders suspended between a head rail and a bottom rail of a Venetian blind for holding a plurality of equally spaced slats thereon before respectively fixed onto a pair of adjusting seats that, having an adjusting shaft mounted thereon, are accommodated at both ends of the head rail therein to tilt the slats into different angles thereby. A lift cord is applied to sequentially thread through cord passages of each slat before wound and suspended from a first pulley seat adapted at one end of the head rail to raise or lower the slats thereby. Between the adjusting seats inside the head rail is situated a positioning seat with a set of guide sliding members accommodated at both sides thereof in linking movement with a linkage actuating plate controlled by an operational cord that is wound and suspended from a second pulley seat adapted at the other end of the head rail. A set of second string ladders whose upper ends are respectively fixed to the guide sliding members thereof are mounted to extend downwards in a U-shaped form to cross the bottom rail, and multiple positioning steps of the second string ladder are applied to hold in place every even/odd-numbered slats thereby. Therefore, the operational cord is simply drawn to trigger the linkage mechanism and synchronically lift the second string ladders so as to alternatively collect and arrange the slats in pairs, facilitating an easier and speedier operation thereof to achieve the best using status.

12 Claims, 7 Drawing Sheets

VENETIAN BLIND SLAT CONTROL MECHANISM

BACKGROUND OF THE INVENTION

The present invention is related to a Venetian blind slat control mechanism, comprising a set of first string ladders suspended between a head rail and a bottom rail of a Venetian blind for holding a plurality of equally spaced slats thereon, and a set of second string ladders whose upper ends are attached to a pair of guide sliding members connected to a linkage actuating plate and controlled by an operational cord attached to the linkage actuating plate thereof; whereby the operational cord is simply drawn to trigger the linkage mechanism thereof and synchronically lift the second string ladders so as to alternatively collect the slats in pairs in an easy and speedy manner without tilting the slats due to uneven pulling force applied thereto. Besides, the operational cord is mounted to one end of the head rail opposite to a lift cord so as to avoid confusing both cords in operation and achieve the best using status thereof.

Please refer to FIG. 1. A conventional Venetian blind slat control mechanism is made up of a Venetian blind 10 having a first string ladder 11 and a second string ladder 12 sequentially mounted to a plurality of slats 13 and respectively crossing the length of a lower rail 14 into U-shaped forms. Positioning slide posts 151 and a first and second pulley seats 152, 153 are respectively disposed at both ends of a head rail 15 for both ends of the first and second string ladders to respectively wind there-through and extend downwards there-from. When the first string ladder 11 is pulled downwards, the slats 13 of odd or even numbers will be actuated to raise upwards, each overlapping with the slat 13 above in pairs to augment the light-passable space as shown in FIG. 2. When the second string ladder 12 is pulled downwards, the slats 13 will keep gathering up from bottom to top in a sequence. A mounting seat with an adjustment member is adapted inside the head rail 15 for retaining a ladder tape (without shown in the diagram) to tilt the slats 13 into different angles thereby.

There are some drawbacks to such conventional Venetian blind slat control mechanism. First, the first and the second string ladders 11, 12 are suspended downwards from the same side of the head rail 15. In practical use, it's easy to confuse the two string ladders 11, 12 and require a repetition of the operation thereof. Besides, in case pulling force is unevenly applied onto both ends of the first or the second string ladders 11, 12, the slats 13 can easily get tilted and result in an inconvenient operation thereof. Second, the first string ladder 11 is wound across the length of the bottom rail 14 thereof. In case of a great pulling force applied thereto, the first string ladder 11 tends to raise upwards the bottom rail 14 and sequentially gather up each slat 13 from bottom to top, losing the function to pile up the slats 13 in pairs. Thus, the conventional Venetian blind slats mechanism is more difficult to manipulate in operation thereof. Third, the first string ladder 11, winding across the length at the inner side of the bottom rail 14, must first actuate the bottom rail 14 before extending through the first pulley seat 152 to suspend downwards there-from, which can waste quite a lot of efforts and pains in the operation thereof.

SUMMARY OF THE PRESENT INVENTION

It is, therefore, the primary purpose of the present invention to provide a Venetian blind slat control mechanism wherein, via guide sliding members with upper ends of second string ladders fixed thereto, and a linkage actuating plate connected with the guide sliding members and controlled by an operational cord attached thereto, the operational cord is simply drawn to trigger the linkage movement of the guide sliding members and synchronically lift the second string ladders in an easy and speedy manner without tilting slats of a Venetian blind due to uneven pulling force applied thereto. Besides, the operational cord is individually mounted to one end of a head rail opposite to a lift cord at the other end thereof as to as to avoid confusing both thereof in operation and achieve the best using status thereof.

It is, therefore, the second purpose of the present invention to provide a Venetian blind slat control mechanism wherein the operational cord is simply drawn to move the linkage actuating plate along with the guide sliding members and synchronically lift the second string ladders so as to alternatively collect the slats so as to alternatively collect and arrange the slats in pairs, facilitating an easier and speedier operation thereof to achieve the best using status.

DETAILED DESCRIPTION OF THE PREFERRED EMBODIMENTS

Figure 1:
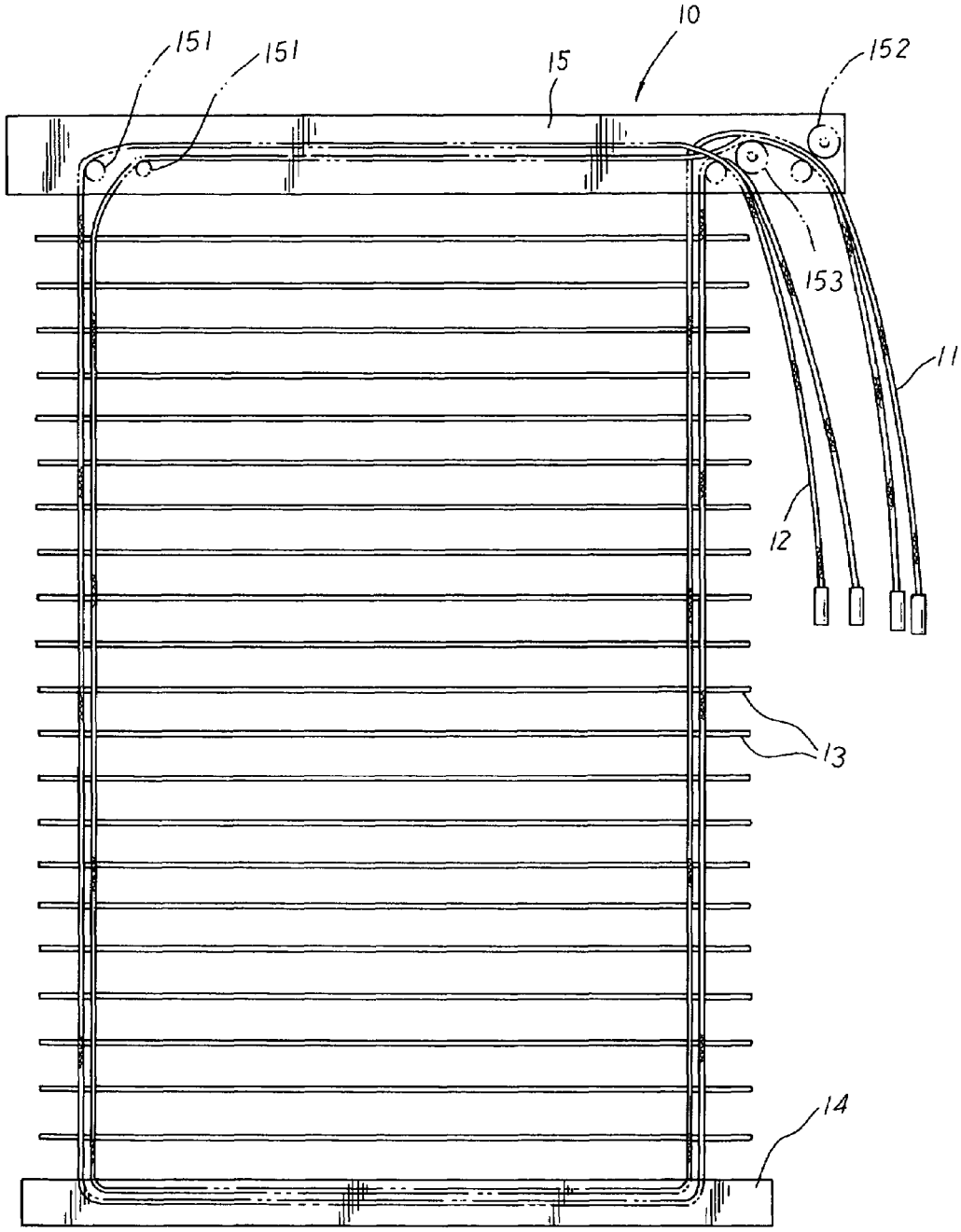
FIG. 1 PRIOR ART
FIG. 1 is a sectional view of a conventional blind slat control mechanism.
Figure 2:
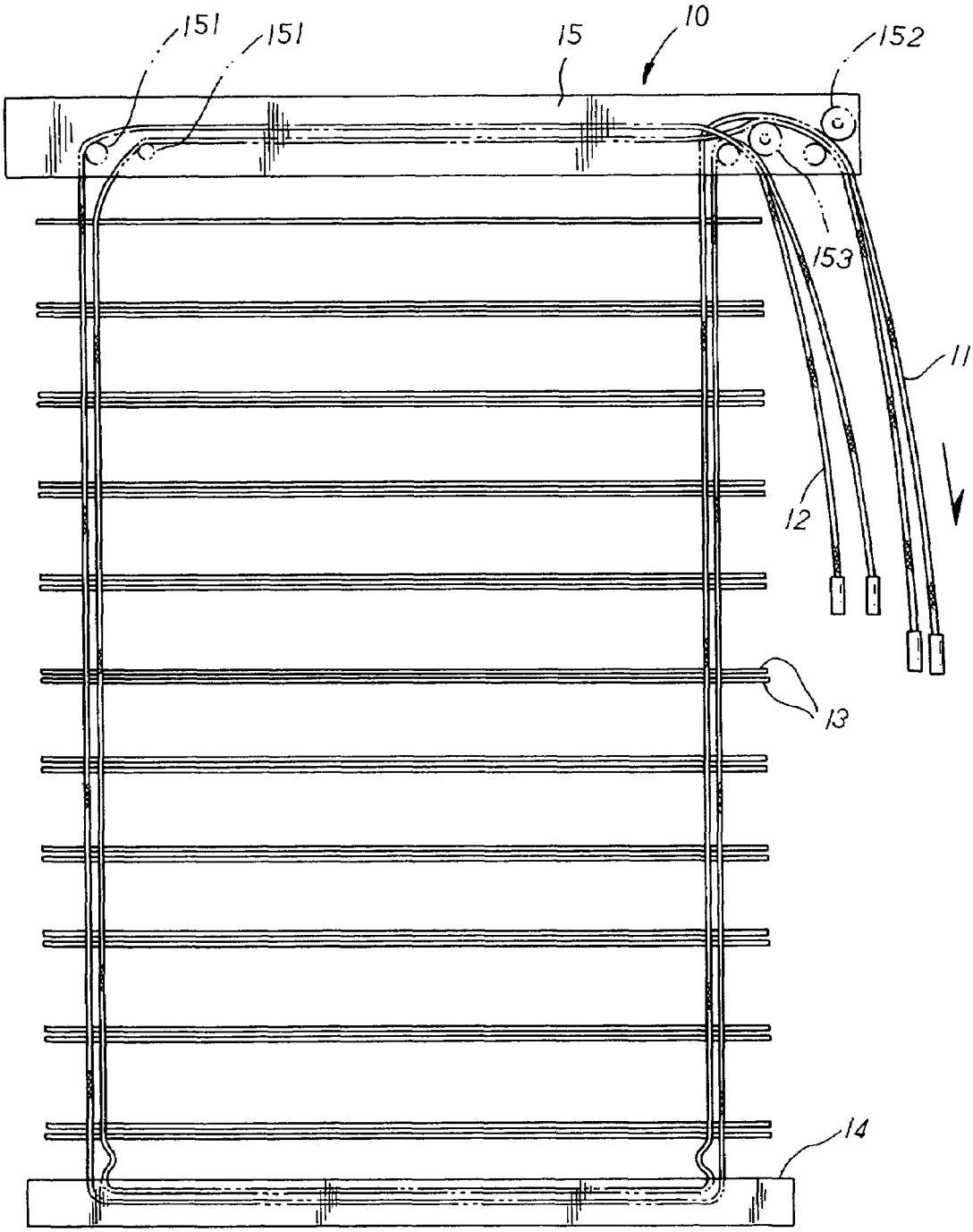
FIG. 2 PRIOR ART
FIG. 2 is a diagram showing the conventional blind slat control mechanism in practical use.
Figure 3:
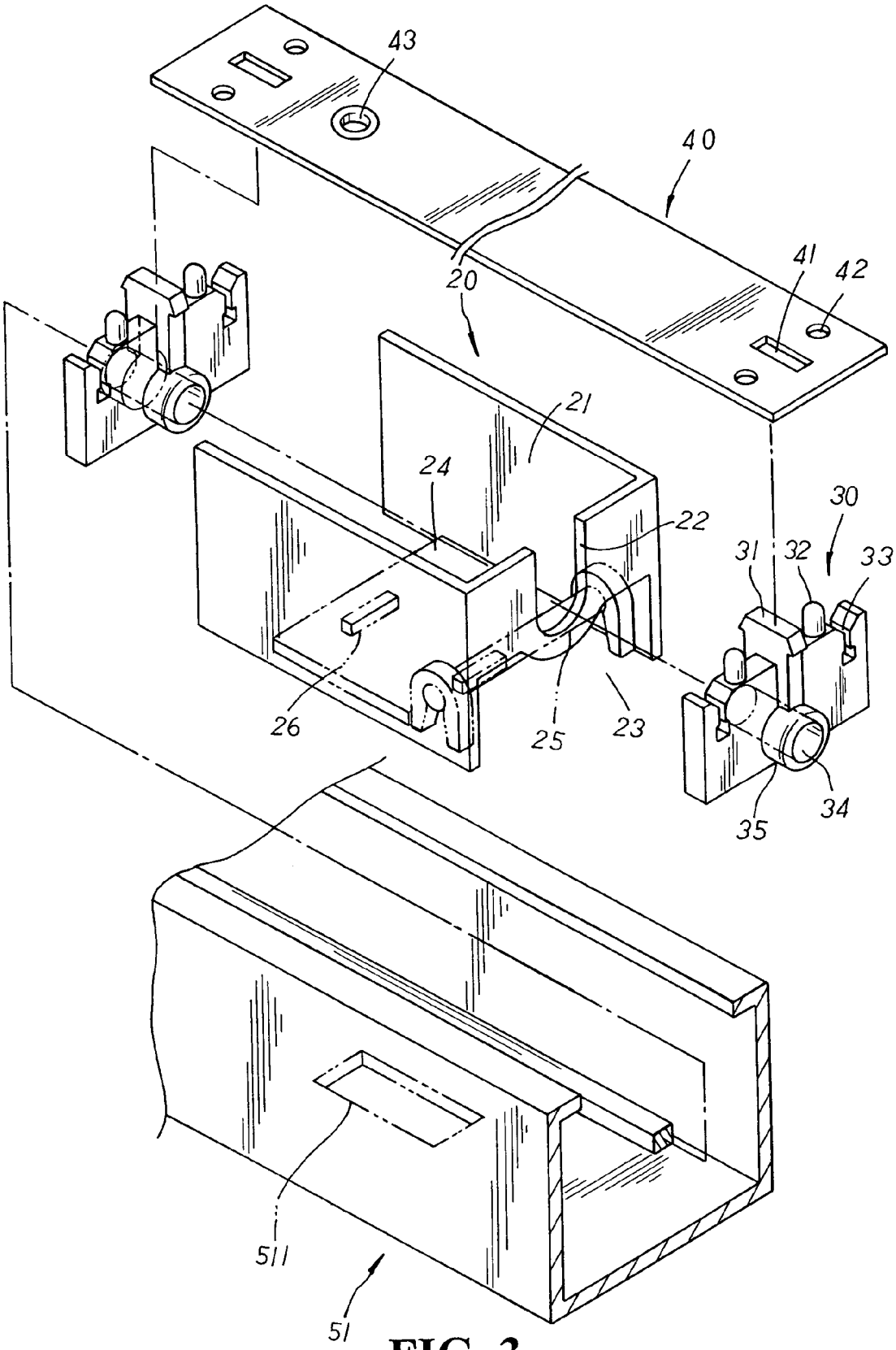
FIG. 3 is an exploded perspective view of the present invention.

Please refer to FIG. 3. The present invention is related to a Venetian blind slat control mechanism, including a positioning seat 20, guide sliding members 30, and a linkage actuating plate 40. The positioning seat 20 is made up of a guide cavity 21 internally cut downwards from the top with a lateral opening disposed at one side thereof, a pivotal retaining groove 22 concaved at the other lateral side wall opposite to the lateral opening of the guide cavity 21 thereof, and a right-angle recessed slot 23 properly cut at the lateral side wall under the pivotal retaining groove 22 thereof to form a guide board 24 at the bottom side of the guide cavity 21 thereof. A slide rod 25 is pivotally mounted at a predetermined position at one side of the recessed slot 23 thereof, and a plurality of coupling blocks 26 are disposed protruding downwards at the bottom surface of the guide board 24 to be engaged with an assembly hole 511 disposed at the interior of a head rail 51 of a Venetian blind 50 for secure abutting location of the positioning seat 20 thereon. The guide sliding member 30 is equipped with a hooked inserting block 31 protruding upwards in the middle section thereof, a pair of protrusive coupling posts 32 with indented retaining grooves 33 symmetrically disposed at both sides of the hooked inserting block 31 thereof, and a pivoting tube 35 with an inner guide thru-hole 34 defined therein symmetrically extending right beneath the hooked inserting block 31 in vertical alignment therewith. The linkage actuating plate 40 is made of a flexible plate body having an inserting slot 41 aligned side by side with a plurality of symmetrical inserting holes 42 properly disposed at the surface of both lateral sides thereon respectively to mate precisely with the hooked inserting block 31 and the coupling posts 32 of the guide sliding member 30 thereof, and a positioning cord hole 43 disposed at a predetermined position thereon.

Figure 4:
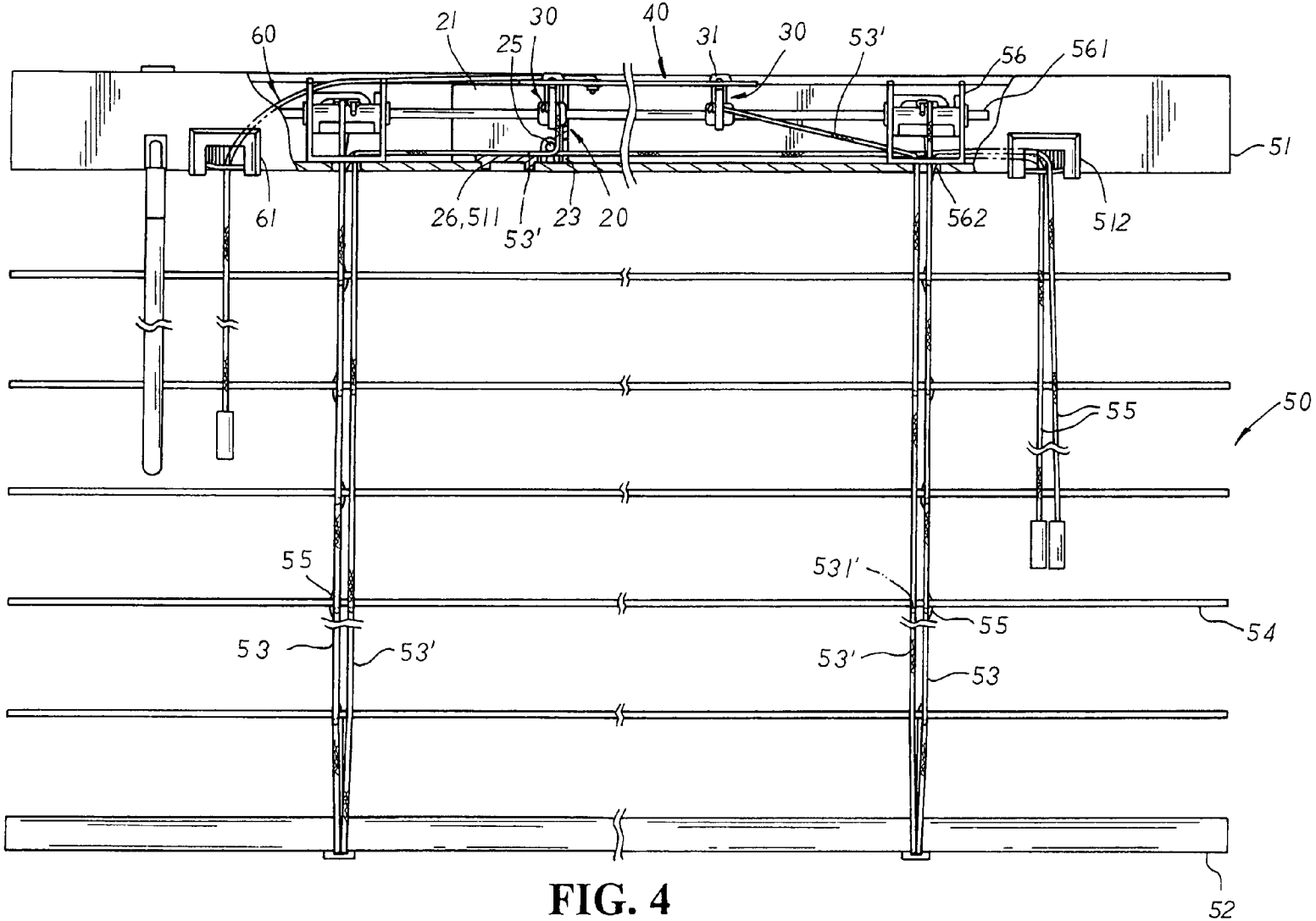
FIG. 4 is a cross-sectional assembled view of the present invention.
Figure 5:
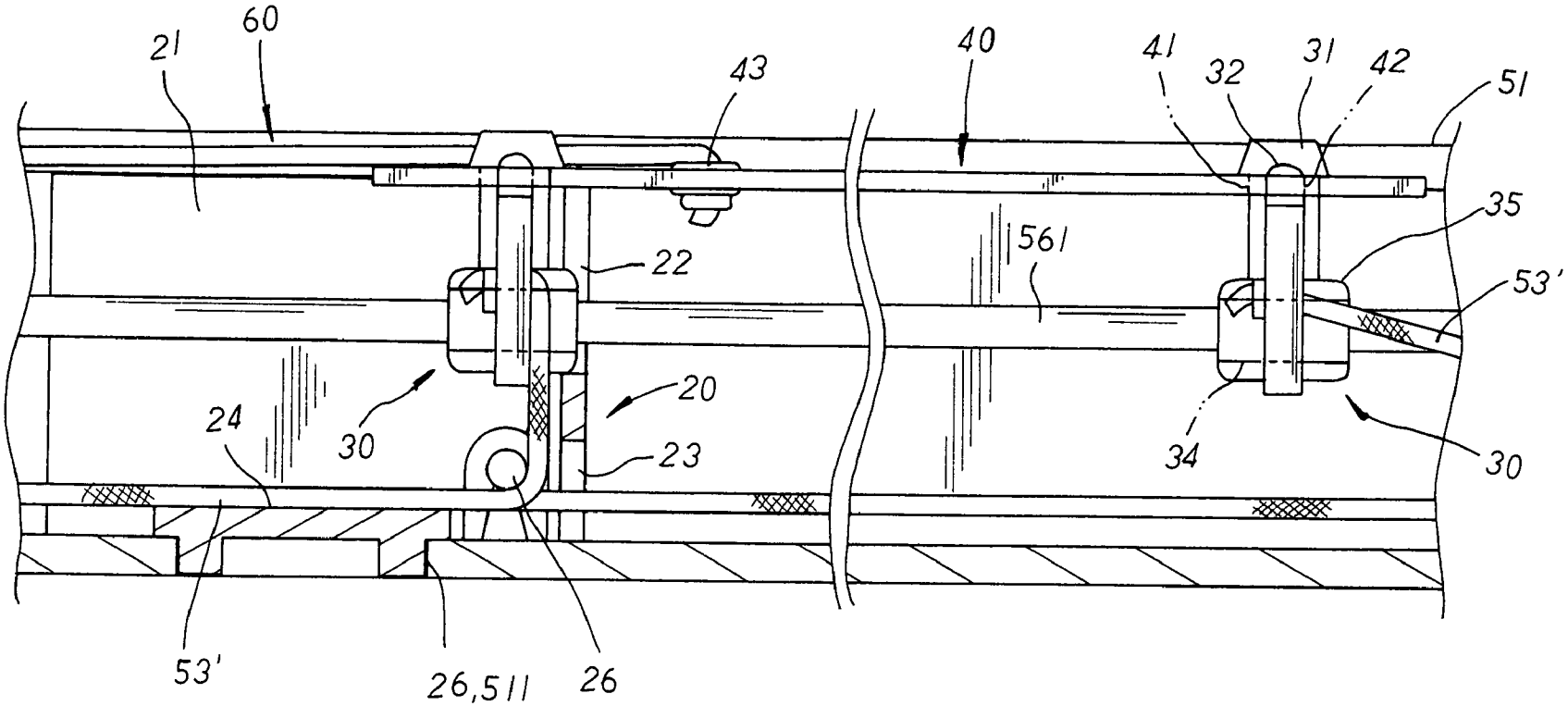
FIG. 5 is a partially enlarged and cross sectional assembled view of the present invention.

Please refer to FIGS. 4 to 5 inclusive. In assembly as shown in FIG. 4, a set of first string ladders 53 are suspended between the head rail 51 and a bottom rail 52 of the Venetian blind 50 for holding a plurality of equally spaced slats 64 in abutting location thereon. A lift cord 55, sequentially led through each slat 54 thereof and fixedly attached to the bottom rail 52 at the bottom end thereof, is guided across the interior of the head rail 51 to wind through a first pulley seat 512 adapted at one end of the head rail 51 therein and extend downwards there-from. The upper ends of each first string ladder 53 are wound and fixed to an adjusting seat 56 that, having an adjusting shaft 561 mounted thereto, is accommodated at each lateral end of the head rail 51 so as to tilt the slats 54 into different angles thereby. The positioning seat 20 is then placed into the head rail 51 till the coupling blocks 26 thereof are securely fixed to the assembly hole 511 thereof, permitting the lift cord 55 extending at the outermost side of the first pulley seat 512 thereof to sequentially pass through the recessed slot 23 of the positioning seat 20 and extend along the guide board 24 thereof till reaching an adjusting seat 56 to wind around the first pulley seat 512 and suspend downwards there-from. A guide sliding member 30 is then applied with the pivoting tube 35 thereof mounted onto the retaining groove 22 from the side of the guide cavity 21 thereof before another guide sliding member 30 is accommodated from the other side to situate at an appropriate position between the retaining groove 22 of the positioning seat 20 and the adjusting seat 56 thereof, permitting the adjusting shaft 561 thereof to pivotally thread through the guide thru-holes 34 of both guide sliding members 30 thereof. At the corresponding sides of each first string ladder 63 is mounted a second string ladder 63' suspended downwards in a U-shaped form to cross the bottom rail 52 thereof and provided with a plurality of positioning steps 531' to hold in place alternatively every even/odd-numbered slats 54 thereby. Both ends of the second string ladder 53' are respectively led upwards through a cord passage hole 562 of the adjusting seat 56 thereof and correspondingly guided towards the adjacent guide sliding member 30 till fixed onto the retaining grooves 323 thereof respectively. One of the second string ladder 53' is first wound around the slide post 25 of the positioning seat 20 (referring to FIG. 5) so as to form a guide sliding effect thereby. Then, the inserting slots 41 and the inserting holes 42 disposed at both lateral end surface of the linkage actuating plate 40 are mounted from top to bottom to engage with the hooked inserting block 31 and the coupling posts 32 of both guide sliding members 30 respectively, permitting the linkage actuating plate 40 to precisely locate on the top side of the positioning seat 31 thereof so as to actuate both guide sliding members 30 in a linkage movement thereby. An operational cord 60 is applied to thread through and fixedly attach to the positioning cord hole 43 of the linkage actuating plate 40 before guided along the upper edge of the linkage actuating plate 40 inside the head rail 51 to wind around a second pulley seat 61 disposed at the other end of the head rail 51 and suspend downward there-from to complete the assembly of the present invention thereof. Therefore, the lift cord 55 thereof is drawn downwards or released to collect or expand the slats 54 thereby.

Figure 6:
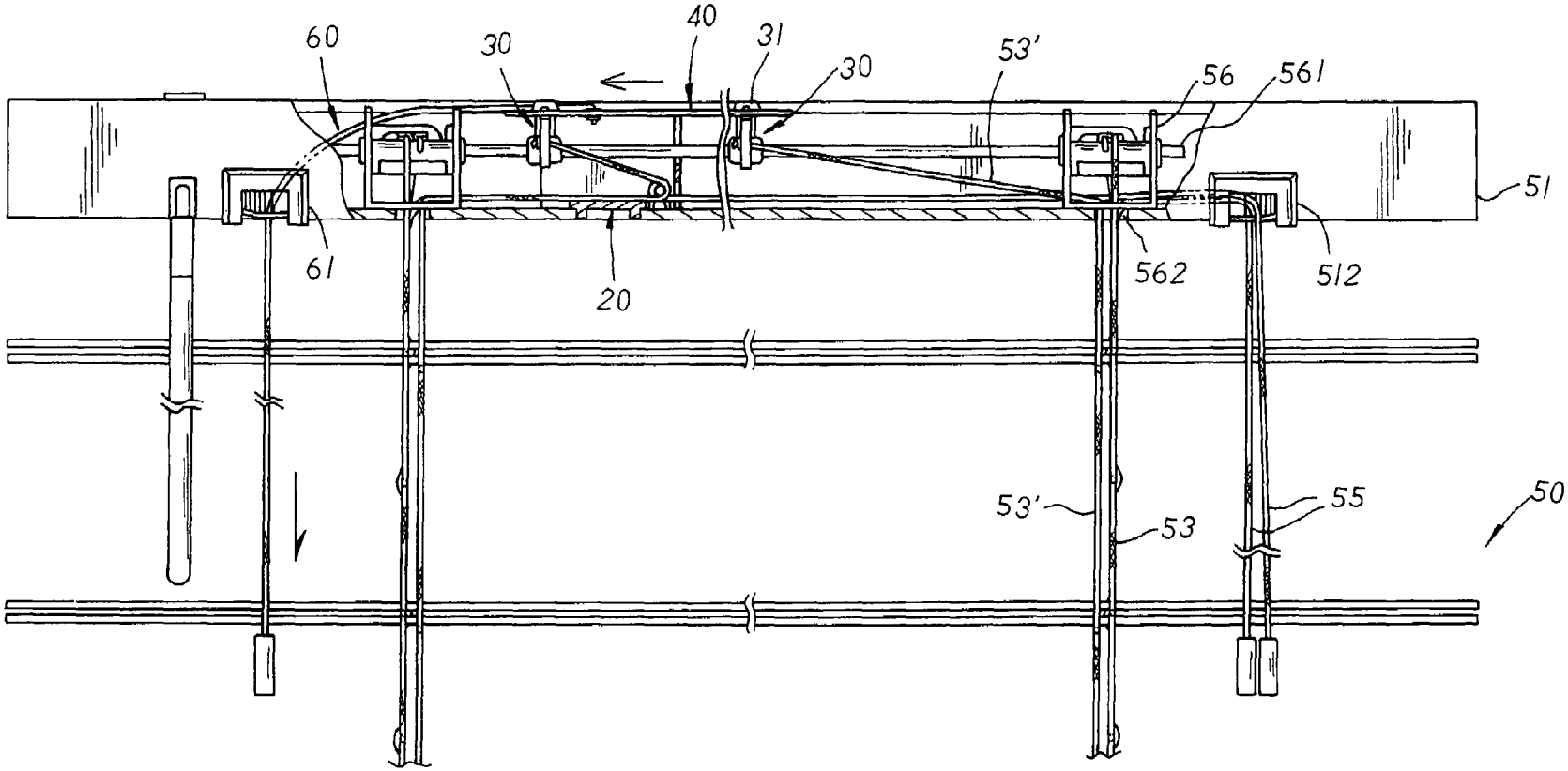
FIG. 6 is a diagram showing an operational cord of the present invention drawn downwards in practical use thereof.
Figure 7:
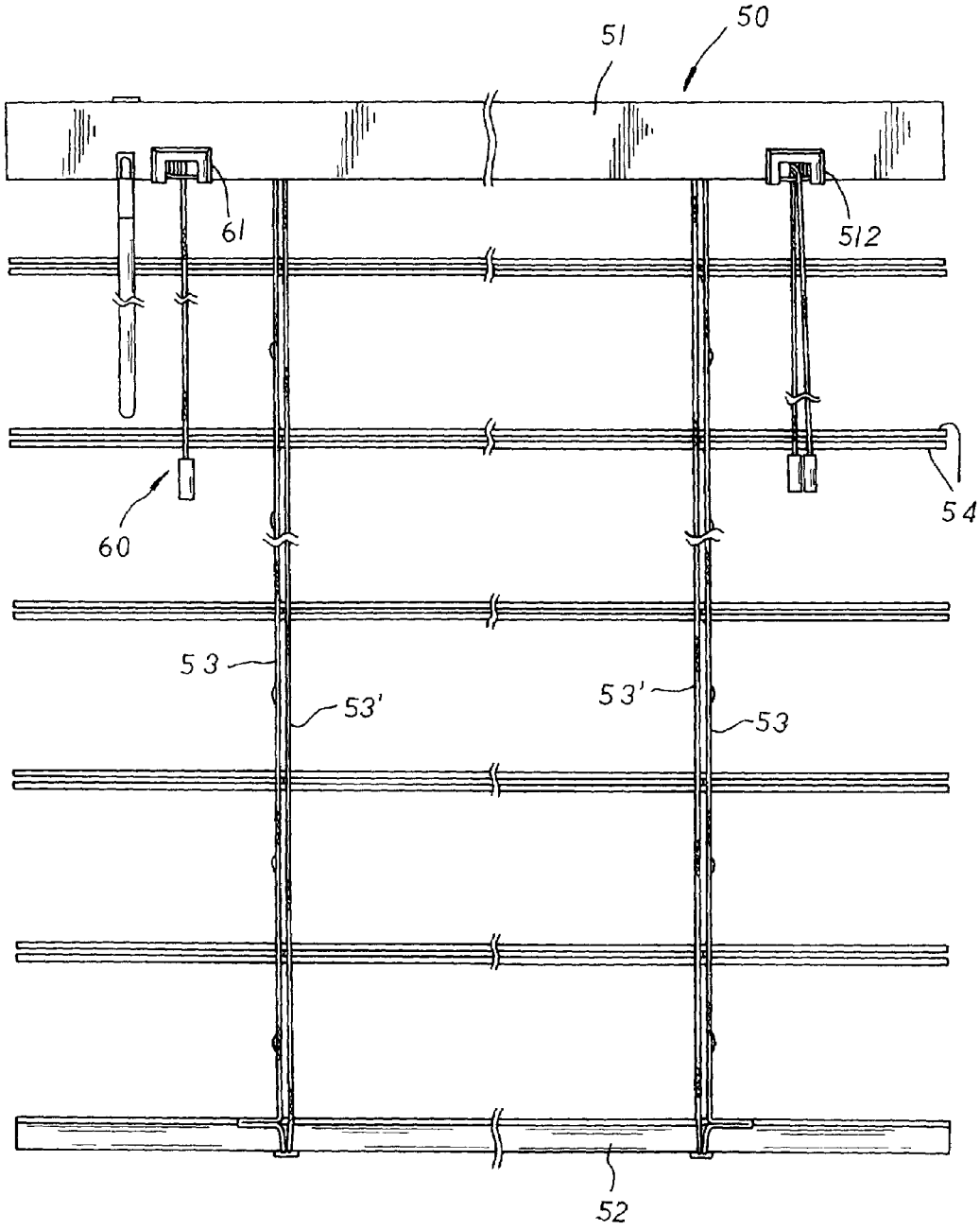
FIG. 7 is a diagram showing slats of the present invention alternatively collected into pairs and positioned in the status thereof.

Please refer to FIG. 6. To increase the light-passable space of the slats 54 thereof, the operational cord 60 is pulled downwards to trigger the movement of the linkage actuating plate 40 that in turn will actuate the guide sliding members 30 to synchronically slide along the guide cavity 21 of the positioning seat 20 towards the second pulley seat 61 thereof. Along with the sliding movement of the guide sliding members 32 thereof, the second string ladder 53' with both ends securely fixed at the retaining grooves 33 therein is actuated to lift upwards therewith, synchronically raising the even/odd-numbered slats 54 held in place by the positioning steps 531' of the second string ladder 63' thereof to abut against the immediate upper slat 54 thereof respectively and piled up in pairs. Then, the pulling force is removed to securely clamp the operational cord 60 via the second pulley seat 61 and precisely relocate the second string ladders 63' at the lift position thereof. Thus, the slats 54 of the Venetian blind 50 can be alternatively collected and arranged in pairs with the light-passable space accurately increased so as to adjust the light coming indoors as shown in FIG. 7. Via the guide sliding members 30 with the second string ladders 53' and the linkage actuating plate 40 connected thereto in a linkage mechanism, the operational cord 60 is simply pulled to actuate the guide sliding members 30 and synchronically lift upwards the second string ladders 53' therewith, efficiently refraining from the risk of tilting the slats 54 due to uneven pulling force applied thereto in operation to achieve the best using status thereof.

To expand the Venetian blind 50 downwards again, the operational cord 60 is drawn to one side to detach from the clamping location of the second pulley seat 61 thereof before the pulling force thereof is properly removed there-from, permitting the second string ladders 53' affected by the gravity of the slats 54' to generate a down-pulling force thereby. The guide sliding members 30 along with the second string ladders 53' actuated by the descending gravity of the slats 54 thereof will drag along the linkage actuating plate 40 connected therewith, permitting both guide sliding members 30 to respectively slide back to their former positions in abutting location by the positioning seat 20 thereof, and the second string ladders 53' to synchronically descend therewith so as to release the collected slats 54 in the expanding operation thereof.

What is claimed is:

1. A Venetian blind slat control mechanism, wherein a set of first string ladders are suspended between a head rail and a bottom rail of a Venetian blind for holding a plurality of equally spaced slats in abutting location thereon, and at both ends inside the head rail thereof is respectively disposed an adjusting seat with an adjusting shaft mounted thereon to tilt the slats into different angles thereby; a lift cord is configured to be sequentially threaded through cord passages of each slat and wound through a first pulley seat adapted at one end of the head rail therein and suspended downwards there-from so as to raise or lower the slats thereby in the collecting or expanding operation thereof; a positioning seat is mounted between the adjusting seats thereof inside the head rail, and a set of guide sliding members is situated at both sides of the positioning seat wherein the upper edge of each guide sliding member is securely engaged with a linkage actuating plate controlled by an operational cord; a set of second string ladders whose upper ends are respectively fixed to the guide sliding members thereof are mounted to extend downwards in a U-shaped form to cross the bottom rail, and multiple positioning steps of the second string ladder are configured to hold in place alternately every even/odd-numbered slats thereby; the operational cord fixedly attached to a positioning cord hole of the linkage actuating plate is guided along from one end of the head rail to wind around a second pulley seat disposed at the other end of the head rail and suspend downward there-from; the operational cord drawn to trigger the movement of the linkage actuating plate and synchronically actuate both guide sliding members that lift upwards the second string ladders with each odd/even-numbered slat raised therewith to abut against the immediate upper slat respectively in pairs; wherein the lift cord and the operational cord are separately mounted at both opposite ends of the head rail respectively.

2. The Venetian blind slat control mechanism as claimed in claim 1, wherein the positioning seat is made up of a guide cavity internally cut downwards from the top with a lateral opening disposed at one side thereof; a pivotal retaining groove concaved at the other lateral side wall opposite to the lateral opening of the guide cavity thereof; a right-angle recessed slot disposed at the lateral side wall under the retaining groove thereof to form a guide board at the bottom side of the guide cavity thereof; and a slide rod pivotally mounted at a predetermined position at one side of the recessed slot thereof.

3. The Venetian blind slat control mechanism as claimed in claim 1, wherein the guide sliding member is configured with a hooked inserting block protruding upwards in the middle section thereof, a pair of protrusive coupling posts with indented retaining grooves symmetrically disposed at both sides of the hooked inserting block thereof, and a pivoting tube with an inner guide thru-hole defined therein symmetrically extending right beneath the hooked inserting block in vertical alignment therewith.

4. The Venetian blind slat control mechanism as claimed in claim 1, wherein the linkage actuating plate has an inserting slot aligned side by side with a plurality of symmetrical inserting holes disposed at the surface of both lateral sides thereon respectively, and a positioning cord hole disposed at a predetermined position thereon.

5. The Venetian blind slat control mechanism as claimed in claim 1, wherein the linkage actuating plate is fabricated from a flexible plate body.

6. The Venetian blind slat control mechanism as claimed in claim 2, wherein the positioning seat has a plurality of coupling blocks protruding downwards at the bottom surface of the guide board thereof to be engaged with an assembly hole disposed at the interior of the head rail for secure abutting location of the positioning seat thereon.

7. A window blind system comprising:

a head rail having a first securing device and a second securing device;

a bottom rail, wherein the bottom rail is suspended from the head rail;

a first plurality of slats and a second plurality of slats horizontally disposed between the head rail and the bottom rail, wherein each of the first plurality of slats is positioned between each of the second plurality of slats;

a set of first string ladders connected between the head rail and the bottom rail for supporting each of the first plurality of slats and each of the second plurality of slats, wherein each string ladder further comprises a first string, a second string, and a first plurality of steps connected horizontally therebetween;

a plurality of lift cords, each lift cord having a first end and a second end, wherein each of the second ends of each lift cord is connected to the bottom rail and wherein each of the lift cords is adjustably secured by the first securing means to position the bottom rail at an adjustable location below the head rail;

an adjusting shaft for tilting the first plurality of slats and the second plurality of slats; and a linkage actuating plate located in the head rail for raising and lowering the second plurality of slats, wherein the linkage actuating plate slides between a first operational position and a second operational position.

8. The window blind system of claim 7, wherein the adjusting shaft differentially adjusts the length of the first and the length of the second string of each set of the first string ladders thereby angling the first set of steps relative to the horizontal position.

9. The window blind system of claim 7 further comprising:

a set of second string ladders connected between the head rail and the bottom rail for supporting each of the second plurality of slats and an operational cord connected to the linkage actuating plate, wherein each string ladder set of second string ladders further comprises a third string, a fourth string, and a second plurality of steps connected horizontally therebetween for supporting the each of the second plurality of slats;

wherein each third string and each fourth string of the set of second string ladders is connected to the linkage actuating plate such that when the linkage actuating plate is in the first operational position, each of the second plurality of steps is in a first lowered position below the head rail, and when the linkage actuating plate is in the second operational position, each of the second plurality of steps is in a second lowered position below the head rail; and wherein the operational cord is connected to the linkage actuating plate for sliding the linkage actuating plate between the first operational position and the second operational position, and the operational cord is adjustably secured to the second securing means to secure the linkage actuating plate in any intermediate position between the first operational position and the second operational positions.

10. A Venetian blind slat control apparatus for a window blind having a head rail, a bottom rail, a first plurality of horizontal slats, and a second plurality of horizontal slats, the slat control apparatus comprising:

a linkage actuating plate slideably located in the head rail;

an operational cord connected to the linkage actuating plate for sliding the linkage actuating plate between a first operational position and a second operational position;

a connecting means for connecting each of the second plurality of slats to the linkage actuating plate; and a securing device connected to the operational cord for adjustably securing the linkage actuating plate to any position between the first operational and the second operational positions, wherein the bottom rail is suspended beneath the head rail, wherein the each of the first plurality of slats is alternately disposed between each of the second plurality of slats, and wherein each of the first plurality and second plurality of slats is suspended horizontally between the head rail and the bottom rail; and wherein each of the second plurality of slats is in a first lowered position when the linkage actuating plate is in the first operational position, and each of the second plurality of slats is in a second lowered position when the linkage actuating plate is in the second operational position.

11. The Venetian blind slat control apparatus of claim 10, wherein each of the slats of the second plurality of slats abuts the adjacent slat of the first plurality of slats when each of the slats of the second position is in the second lowered position.

12. A Venetian blind slat control apparatus for a window blind having a head rail, a bottom rail, a first plurality of horizontal slats, and a second plurality of horizontal slats, wherein the bottom rail is suspended beneath the head rail, wherein the each of the first plurality of slats is alternately disposed between each of the second plurality of slats, and wherein each of the first plurality and second plurality of slats is suspended horizontally between the head rail and the bottom rail, the slat control apparatus comprising:

a means for moving each of the second plurality of slats from a first lowered position to a second lowered position, wherein each of the slats of the second plurality of slats abuts the adjacent slat of the first plurality of slats when each of the slats of the second position is in the second lowered position;

wherein the means for moving each of the second plurality of slats further comprises:

a linkage actuating plate slidably located in the head rail;

a means for connecting each of the second plurality of slats to the linkage actuating plate;

a means for sliding the linkage actuating plate between a first operational position and a second operational position, and for adjustable securing the linkage actuating plate in any intermediate position, wherein each of the second plurality of slats is in the first lowered position when the linkage actuating plate is in the first operational position and is in the second lowered position when the linkage actuating plate is in the second operational position.

* * * * *